US006920827B2

(12) United States Patent
Llyod

(10) Patent No.: US 6,920,827 B2
(45) Date of Patent: Jul. 26, 2005

(54) VEHICLE-BORNE SYSTEM AND METHOD FOR COUNTERING AN INCOMING THREAT

(75) Inventor: Richard M. Llyod, Melrose, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/698,500

(22) Filed: Oct. 31, 2003

(65) Prior Publication Data

US 2005/0115450 A1 Jun. 2, 2005

(51) Int. Cl.[7] ..... F42B 12/30
(52) U.S. Cl. ..... 102/497; 102/475; 102/211
(58) Field of Search ..... 89/36.17; 102/475, 102/476, 494, 495, 496, 497, 211

(56) References Cited

U.S. PATENT DOCUMENTS

| | | | | |
|---|---|---|---|---|
| 1,198,035 A | | 9/1916 | Huntington | |
| 1,229,421 A | | 6/1917 | Downs | |
| 1,235,076 A | | 7/1917 | Stanton | |
| 1,244,046 A | | 10/1917 | Efrench | |
| 1,300,333 A | | 4/1919 | Berry | |
| 1,305,967 A | | 6/1919 | Hawks | |
| 2,296,980 A | | 9/1942 | Carmichael | |
| 2,308,683 A | | 1/1943 | Forbes | |
| 2,322,624 A | | 6/1943 | Forbes | |
| 2,337,765 A | | 12/1943 | Nahirney | |
| 2,925,965 A | | 12/1960 | Pierce | |
| 2,988,994 A | | 6/1961 | Fleischer, Jr. et al. | |
| 3,332,348 A | | 7/1967 | Myers et al. | |
| 3,565,009 A | * | 2/1971 | Allred et al. | 102/475 |
| 3,656,433 A | | 4/1972 | Thrailkill et al. | |
| 3,665,009 A | | 5/1972 | Dickinson, Jr. | |
| 3,757,694 A | | 9/1973 | Talley et al. | |
| 3,771,455 A | | 11/1973 | Haas | |
| 3,796,159 A | | 3/1974 | Conger | |

(Continued)

FOREIGN PATENT DOCUMENTS

| | | | |
|---|---|---|---|
| DE | 3327043 A1 | | 2/1985 |
| DE | 38 30 527 A1 | | 3/1990 |
| DE | 3934042 A1 | | 4/1991 |
| EP | 270 401 A1 | | 6/1988 |
| FR | 2 678 723 | | 1/1993 |
| FR | 2 678 723 A1 | * | 1/1993 |
| GB | 550001 | | 12/1942 |
| GB | 2236581 | | 4/1991 |
| JP | 1-296100 | * | 11/1989 |
| WO | WO 97/27447 | | 7/1997 |

OTHER PUBLICATIONS

FAS Military Analysis Network (http://www.fas.org/man/dod–101/sys/land/m546.htm): M546 APERS–T 105–mm, Jan. 21, 1999, 1 page.

FAS Military Analysis Network (http://www.fas.org/man/dod–101/sys/land/bullets2.htm): Big Bullets for Beginners, Feb. 6, 2000, 11 pages.

(Continued)

*Primary Examiner*—Stephen M. Johnson
(74) *Attorney, Agent, or Firm*—Iandiorio & Teska

(57) ABSTRACT

A vehicle-borne system for countering an incoming threat, the system including a sensing device configured to sense an incoming threat, and an active protection system including a maneuverable interceptor incorporating a plurality of kinetic energy rods and an aimable explosive charge configured to deploy the kinetic energy rods in a predetermined direction; the active protection system further including a detection subsystem configured to maneuver the interceptor to intercept the incoming threat, the detection subsystem further configured to determine if the interceptor will miss the threat, and then initiate the explosive charge to aim the kinetic energy rods into a disbursed cloud in the trajectory path of the incoming threat and between the incoming threat and the vehicle.

43 Claims, 15 Drawing Sheets

U.S. PATENT DOCUMENTS

| | | | | |
|---|---|---|---|---|
| 3,797,359 | A | 3/1974 | Mawhinney et al. | |
| 3,818,833 | A | 6/1974 | Throner, Jr. | |
| 3,846,878 | A | 11/1974 | Monson et al. | |
| 3,851,590 | A | 12/1974 | LaCosta | |
| 3,861,314 | A | 1/1975 | Barr | |
| 3,877,376 | A | 4/1975 | Kupelian | |
| 3,902,424 | A | 9/1975 | Dietsch et al. | |
| 3,903,804 | A | 9/1975 | Luttrell et al. | |
| 3,915,092 | A | 10/1975 | Monson et al. | |
| 3,941,059 | A | 3/1976 | Cobb | |
| 3,949,674 | A | 4/1976 | Talley | |
| 3,954,060 | A | 5/1976 | Haag et al. | |
| 3,977,330 | A | 8/1976 | Held | |
| 4,026,213 | A | 5/1977 | Kempton | |
| 4,036,140 | A | 7/1977 | Korr et al. | |
| 4,089,267 | A | 5/1978 | Mescall et al. | |
| 4,106,410 | A | 8/1978 | Borcher et al. | |
| 4,147,108 | A | 4/1979 | Gore et al. | |
| 4,172,407 | A | 10/1979 | Wentink | |
| 4,210,082 | A | 7/1980 | Brothers | |
| 4,211,169 | A | 7/1980 | Brothers | |
| 4,231,293 | A | 11/1980 | Dahn et al. | |
| 4,289,073 | A | 9/1981 | Romer et al. | |
| 4,376,901 | A | 3/1983 | Pettibone et al. | |
| 4,430,941 | A | 2/1984 | Raech, Jr. et al. | |
| 4,455,943 | A | 6/1984 | Pinson | |
| 4,516,501 | A | 5/1985 | Held et al. | |
| 4,538,519 | A | 9/1985 | Witt et al. | |
| 4,638,737 | A | 1/1987 | McIngvale | |
| 4,655,139 | A | 4/1987 | Wilhelm | |
| 4,658,727 | A | 4/1987 | Wilhelm et al. | |
| 4,676,167 | A | 6/1987 | Huber, Jr. et al. | |
| 4,745,864 | A | 5/1988 | Craddock | |
| 4,770,101 | A | 9/1988 | Robertson et al. | |
| 4,777,882 | A | 10/1988 | Dieval | |
| 4,848,239 | A | 7/1989 | Wilhelm | |
| 4,922,826 | A | 5/1990 | Busch et al. | |
| 4,957,046 | A | 9/1990 | Puttock | 102/489 |
| 4,995,573 | A | 2/1991 | Wallow | 244/3.24 |
| 4,996,923 | A | 3/1991 | Theising | |
| H1047 | H | 5/1992 | Henderson et al. | |
| H1048 | H | 5/1992 | Wilson et al. | |
| 5,182,418 | A | 1/1993 | Talley | |
| 5,223,667 | A | 6/1993 | Anderson | 102/517 |
| 5,229,542 | A | 7/1993 | Bryan et al. | |
| 5,313,890 | A | 5/1994 | Cuadros | |
| 5,370,053 | A | 12/1994 | Williams et al. | |
| 5,524,524 | A | 6/1996 | Richards et al. | |
| 5,535,679 | A | 7/1996 | Craddock | |
| 5,542,354 | A | 8/1996 | Sigler | |
| 5,544,589 | A | 8/1996 | Held | |
| 5,577,431 | A | 11/1996 | Küsters | |
| 5,578,783 | A | 11/1996 | Brandeis | |
| 5,583,311 | A | 12/1996 | Rieger | |
| 5,622,335 | A | 4/1997 | Trouillot et al. | 244/3.24 |
| D380,784 | S | 7/1997 | Smith | D21/49 |
| 5,670,735 | A | 9/1997 | Ortmann et al. | |
| 5,691,502 | A | 11/1997 | Craddock et al. | |
| 5,796,031 | A | 8/1998 | Sigler | |
| 5,823,469 | A | 10/1998 | Arkhangelsky et al. | |
| 5,929,370 | A | 7/1999 | Brown et al. | 102/399 |
| 5,936,191 | A | 8/1999 | Bisping et al. | 102/517 |
| 6,035,501 | A | 3/2000 | Bisping et al. | 102/519 |
| 6,044,765 | A | 4/2000 | Regebro | |
| 6,186,070 | B1 | 2/2001 | Fong et al. | |
| 6,276,277 | B1 | 8/2001 | Schmacker | 102/384 |
| 6,279,478 | B1 * | 8/2001 | Ringer et al. | 102/213 |
| 6,279,482 | B1 * | 8/2001 | Smith et al. | 102/374 |
| 6,598,534 | B2 * | 7/2003 | Lloyd et al. | 102/494 |
| 6,622,632 | B1 | 9/2003 | Spivak | |
| 6,666,145 | B1 | 12/2003 | Nardone et al. | |
| 2003/0019386 | A1 | 1/2003 | Lloyd et al. | |
| 2004/0011238 | A1 | 1/2004 | Ronn et al. | |

OTHER PUBLICATIONS

U.S. Appl. No. 10/924,104, filed Aug. 23, 2004, Lloyd.
U.S. Appl. No. 10/938,355, filed Sep. 10, 2004, Lloyd.
U.S. Appl. No. 10/960,842, filed Oct. 7, 2004, Lloyd.
Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99–197.
Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311–406.
Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193–251.
Richard M. Lloyd, "Aligned Rod Lethality Enhanced Concept for Kill Vehicles", 10th AIAA.BMDD Technology Conf., Jul. 23–26, Williamsburg, Virginia, 2001, pp. 1–12.
U.S. Appl. No. 10/162,498, filed Jun. 4, 2002, Lloyd.
U.S. Appl. No. 10/301,302, filed Nov. 21, 2002, Lloyd.
U.S. Appl. No. 10/301,420, filed Nov. 21, 2002, Lloyd.
U.S. Appl. No. 10/384,804, filed Mar. 10, 2003, Lloyd.
U.S. Appl. No. 10/385,319, filed Mar. 10, 2003, Lloyd.
U.S. Appl. No. 10/456,391, filed Jun. 5, 2003, Lloyd et al.
U.S. Appl. No. 10/456,777, filed Jun. 6, 2003, Lloyd.
U.S. Appl. No. 10/685,242, filed Oct. 14, 2003, Lloyd.
U.S. Appl. No. 10/370,892, filed Feb. 20, 2003, Lloyd.

* cited by examiner

VEHICLE-BORNE SYSTEM AND METHOD FOR COUNTERING AN INCOMING THREAT

FIELD OF THE INVENTION

This invention relates to a vehicle-borne system and method for countering an incoming threat to a vehicle such as a tank or armored personnel carrier.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, THAAD or a standard Block IV missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook proposes a kinetic energy rod warhead.

The two primary advantages of a kinetic energy rod warhead are that 1) it does not rely on precise navigation as is the case with "hit-to-kill" vehicles and 2) it provides better penetration than blast fragmentation type warheads. The above technology developed by the inventor hereof can be modified and adapted to destroy heat and kinetic energy rounds that are designed to defeat tanks or armored personnel carriers.

One of the most serious incoming threats to targets such as tanks, armored personnel carriers, and the like, is the heat (shaped charge) round or the kinetic energy round (KER). The KER is the most difficult to destroy or deflect and is typically ½ inch to 1 inch in diameter and approximately 30 inches long. The KER travels at approximately 1.6 km/second and is designed to pierce the armor of tanks and armored personnel carriers. Prior active protection systems (APS) and methods to counter incoming threats, such as the KER or heat round, include small "hit-to-kill" vehicles and conventional blast fragmentation-type warheads. However, these prior systems and methods are typically ineffective against the incoming threat because the "hit-to-kill" vehicles often miss the intended target and the blast or fragmentation-type warheads are typically ineffective at destroying or altering the flight path of the KER or heat round. This is because about 97% of the fragments from a conventional isotropic blast fragmentation type warhead are ejected away from the KER or heat round. Since the KER or heat round is so small, most of the fragments are wasted, hence, this type of conventional warhead lacks the overall hits required to destroy a KER or heat round.

SUMMARY OF THE INVENTION

It is therefore an object of this invention to provide a vehicle-borne warhead system and method for countering an incoming heat round or KER threat.

It is a further object of this invention to provide such a system and method which effectively destroys an incoming threat.

It is a further object of this invention to provide such a system and method which effectively breaks or fractures an incoming KER or heat round.

It is a further object of this invention to provide such a system and method which effectively destroys tank rounds, missiles and artillery fire.

It is a further object of this invention to provide such a system and method which effectively displaces or deflects the flight path of an incoming KER or heat round threat such that the KER or heat round threat will miss the intended target.

It is a further object of this invention to provide such a system and method which effectively displaces or deflects the flight path of tank rounds, missiles, and artillery fire such that the tank rounds, missiles, and artillery fire will miss the intended target.

It is a further object of this invention to provide such a system and method which can determine if a counter-munition will miss the incoming threat, and if so, effectively destroy the incoming threat.

It is a further object of this invention to provide such a warhead system and method which can determine if a counter-munition will miss the incoming threat, and if so, effectively alter the flight path of the incoming threat so it will miss the intended target.

The invention results from the realization that truly effective vehicle-borne system and method for countering an incoming threat can be achieved by the unique combination of: 1) a sensing device configured to sense an incoming threat; and 2) an active protection system which includes a) a maneuverable interceptor with a plurality of kinetic energy rods and an explosive charge configured to aim the kinetic energy rods in the direction of the incoming threat, and b) a detection subsystem configured to maneuver the interceptor to intercept the incoming threat and determine if the interceptor will miss the threat; if the detection subsystem determines the interceptor will miss the incoming threat, it will initiate the explosive charge of the interceptor to aim the kinetic energy rods in a disbursed cloud in the trajectory path of the incoming threat, thereby effectively destroying or altering the flight path of the incoming threat such that it misses the vehicle.

This invention features a vehicle-borne system for countering an incoming threat, the system including a sensing device configured to sense an incoming threat, and an active protection system including a maneuverable interceptor incorporating a plurality of kinetic energy rods and an explosive charge configured to aim the kinetic energy rods in a predetermined direction; the active protection system further including a detection subsystem configured to maneuver the interceptor to intercept the incoming threat, the detection subsystem further configured to determine if the interceptor will miss the threat, and then initiate the explosive charge to aim the kinetic energy rods into a disbursed cloud in the trajectory path of the incoming threat and between the incoming threat and the vehicle.

In one embodiment the incoming threat may be chosen from the group consisting of a kinetic energy round munition, a shaped charge, a heat round, a missile, an artillery, and a stabilizer rod. The vehicle may be a tank. The vehicle may be an armored personnel carrier. The interceptor may include a warhead section with a plurality of bays for holding the plurality of kinetic energy rods. The bays may be orientated such that the kinetic energy rods are deployed in different predetermined directions for creating the disbursed cloud. The detection subsystem may include a radar module for determining if the interceptor will hit or miss the incoming threat. The detection subsystem may include a fuze control unit for initiating the explosive charge. The kinetic energy rods may be made of tantalum. The rods may be hexagon shaped. The kinetic energy rods may have a cylindrical cross section, a non-cylindrical cross section, a star-shaped cross section, a cruciform cross section, flat ends, a non-flat nose, a pointed nose, a disk shape with flat ends, or a wedge-shaped nose. The kinetic energy rods may have a ductile composition for preventing shattering thereof. The explosive charge may be shaped such that detonation of the charge deploys the plurality of kinetic energy rods in a predetermined direction to form the disbursed cloud.

The vehicle may be a tank, such as a BMP-3 tank, a T-80MBT tank, a BMP-3 ICV tank, an ARENA APS tank, or a T-80UM2 tank.

This invention also features a vehicle-borne incoming threat countering method, the method including sensing an incoming threat, activating an active protection system including a maneuverable interceptor incorporating a plurality of kinetic energy rods and an aimable explosive charge configured to deploy the kinetic energy rods in a predetermined direction, maneuvering the interceptor to intercept the incoming threat, detecting whether the interceptor will miss the incoming threat, and if the interceptor will miss the incoming threat, then initiating the explosive charge to aim the kinetic energy rods into a disbursed cloud in the trajectory path of the incoming threat and between the incoming threat and the vehicle.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 2:
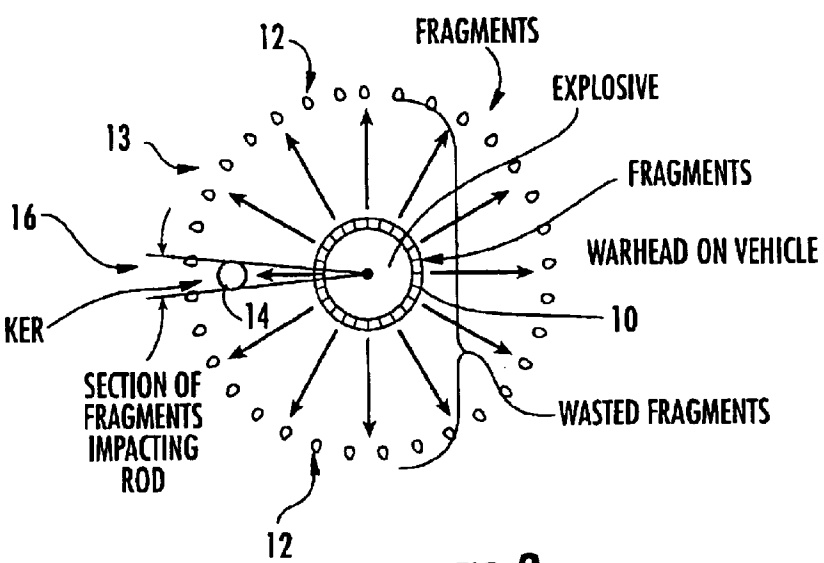
FIG. 2 (PRIOR ART)
FIG. 2 is a schematic front view showing the ineffective spray pattern of fragments of the conventional blast fragmentation-type warhead shown in FIG. 1.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

Figure 1:
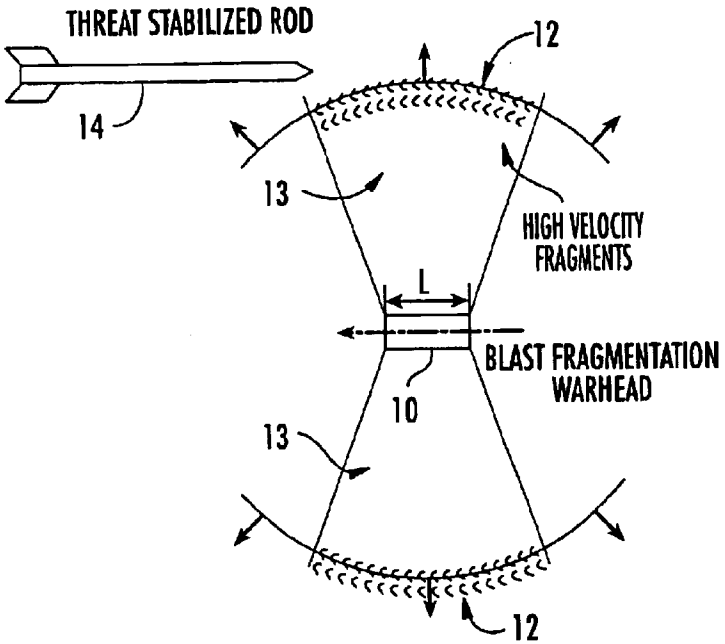
FIG. 1 (PRIOR ART)
FIG. 1 is a schematic side view showing the typical deployment of a conventional blast fragmentation-type warhead in accordance with the prior art.

As discussed in the Background section, conventional warhead designs and methods cannot achieve a hard kill by breaking an incoming threat, such as a KER or heat round (shaped charge) into many pieces. Conventional warheads can only achieve soft or deflection kills of the KER or heat round which does not ensure high probability of survival of a home vehicle, e.g., a tank or armored personnel carrier. As shown in FIG. 1, conventional warhead 10 deploys fragments 12 such that the majority (e.g., 97%) of fragments 12 miss intended incoming threat or target 14 (e.g., a KER or a heat round). As shown in FIG. 2, where like parts have been given like numbers, prior art blast or fragmentation-type warhead 10 produces spray pattern 13 with small section 16 of penetrators 12 which actually impact KER 14. In this example, only about 2–3% of fragments 12 hit KER 14, while about 97% fragments miss KER 14 and are wasted. As shown above, only about 2–3% of fragments 12 have the potential to impact the small diameter rod of KER 14. Additionally, if the miss distance is somewhat large, then fragments 12 would spread far away, generating holes in spray pattern 13, hence allowing the KER 14 to fly through spray pattern 13 without being hit. Conventional blast fragmentation-type warhead 10, FIGS. 1 and 2, therefore, lacks the overall number of hits of fragments 12 on incoming threat or KER 14 to effectively destroy KER 14 or alter its flight path.

Figure 3:
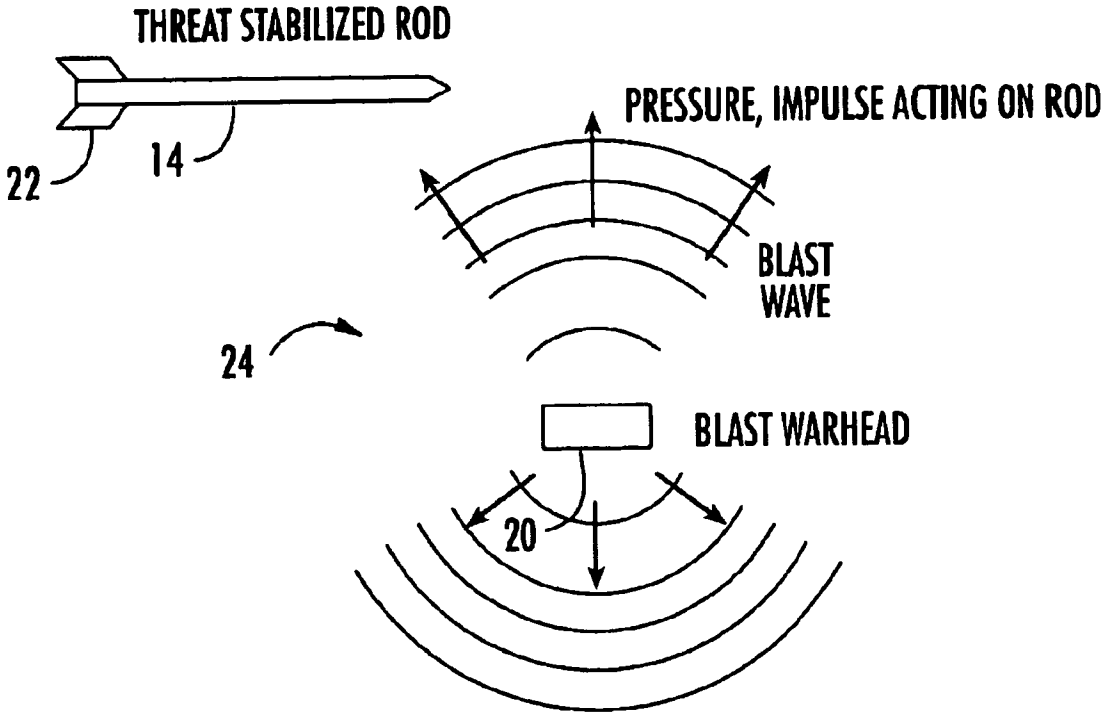
FIG. 3 (PRIOR ART)
FIG. 3 is a schematic view showing the deployment of a blast wave pattern in accordance with a prior art blast fragmentation-type warhead.

Conventional blast-type warhead 20, FIG. 3 is also unable to effectively break or destroy KER 14. Warhead 20 is only capable of deflecting KER 14 by destroying fins 22. Pressure or impulse from blast wave 24 decays extremely fast, hence the deployment of blast wave 24 requires very accurate timing of the fuze and small miss distance in order to achieve any secondary kill level (e.g., destroying fins 22 or KER 14).

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook proposes an aimable kinetic energy rod warhead.

Two key advantages of kinetic energy rod warheads as theorized is that: 1) they do not rely on precise navigation as is the case with "hit-to-kill" vehicles; and 2) they provide better penetration and higher spray density compared to blast fragmentation type warheads. Further details concerning kinetic energy rod warheads and penetrators (projectiles) are disclosed in co-pending U.S. patent application Ser. No. 09/938,022 filed Aug. 23, 2001 (RAY-123J); U.S. patent application Ser. No. 10/162,498 filed Jun. 4, 2002 (RAY-126J); U.S. patent application Ser. No. 10/301,420 filed Nov. 21, 2002 (RAY-137J); U.S. patent application Ser. No. 10/385,319 filed Mar. 10, 2003 (RAY-139J); U.S. patent application Ser. No. 10/370,892 filed Feb. 20, 2003 (RAY-140J); U.S. patent application Ser. No. 10/456,391 filed Jun. 5, 2003 (RAY-142J); and U.S. patent application Ser. No. 10/456,777 filed Jun. 6, 2003 (RAY-143J). All of these applications are incorporated by reference herein.

One idea behind the subject invention is to deploy a maneuverable interceptor which includes a plurality of kinetic energy rods and an explosive device which is configured to aim the kinetic energy rods in the direction of incoming threat. The system and method of this invention can determine if the interceptor will miss the incoming threat, and, in the event of a miss, initiate the explosive charge within the interceptor to aim the kinetic energy rods in a disbursed cloud in the trajectory path of the incoming threat to effectively destroy or disrupt the flight path of the incoming threat.

In accordance with this invention, a novel active protection warhead has been developed to generate a hard kill against an armor piercing stabilizer rod, such as heat round (shaped charge) threat or KER. This design is superior to conventional designs and methods because the aimable interceptor allows about 80% of its overall weight to be used as penetrators. This provides the ability for all of the kinetic energy rods (penetrators) to be deployed in one direction and generate a dense cloud of penetrators or kinetic energy rods. When the enemy rod (e.g., a KER or heat round) travels through the cloud, the KER or heat round is broken into many small fragments or pieces. The rod pieces of the enemy KER or heat round then tumble and fall short of the intended target, hence providing protection to tanks, armored personnel carriers, and the like. The vehicle-borne system and method for countering an incoming threat of this invention can be applied to both future and current ground vehicle systems. The innovative warhead system of this invention provides an effective way to deflect, disrupt, and achieve a hard kill (e.g., destroy) against all anti-armor threats, including, inter alia, KERs, heat rounds, tank rounds, missiles and artillery fire. Other conventional warhead designs and methods, such as high explosive or multiple explosively formed projectiles (EFP) warheads have less performance compared to the aimable kinetic energy rod warhead of this invention. Conventional blast-only warheads require very small miss distances with fuzing concepts that have extremely tight tolerances. Conventional fragmenting warheads require interceptors with a tight tolerance because the timing of high velocity projectiles depend on active fuzing requirements. The vehicle borne system and method for countering an incoming threat of this invention deploys all the projectiles at low velocity which relaxes the fuze (interceptor) and forms an expanding cloud of penetrators (kinetic energy rods) that the incoming threat (e.g., KER or heat round) rod flies through and is destroyed. Modeling and design efforts in accordance with this invention have demonstrated that 10 to 20 hits would occur on a typical incoming threat, thereby causing sufficient damage to break the incoming threat into many smaller pieces.

Figure 4:
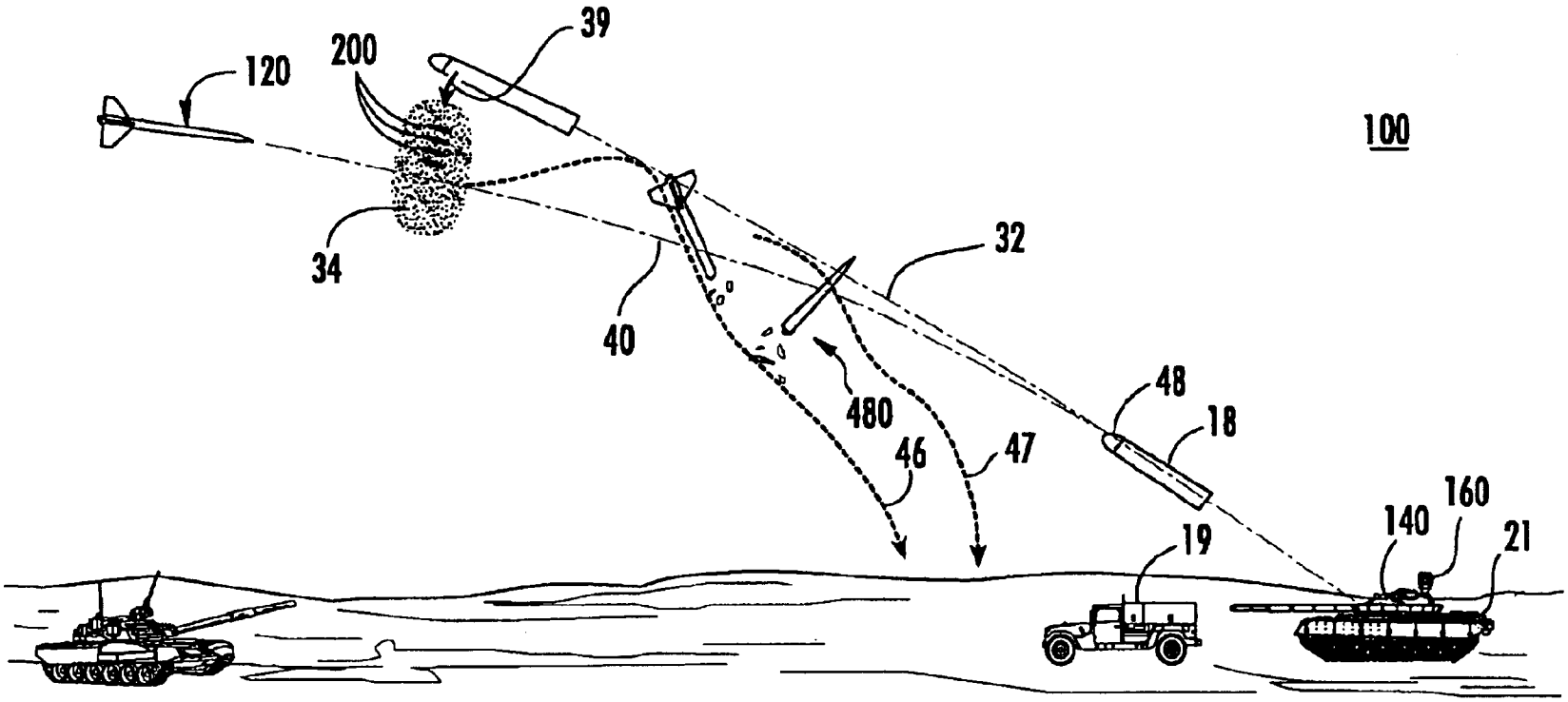
FIG. 4 is a schematic side view depicting the system and method for intercepting an incoming threat in accordance with the subject invention.
Figure 5:
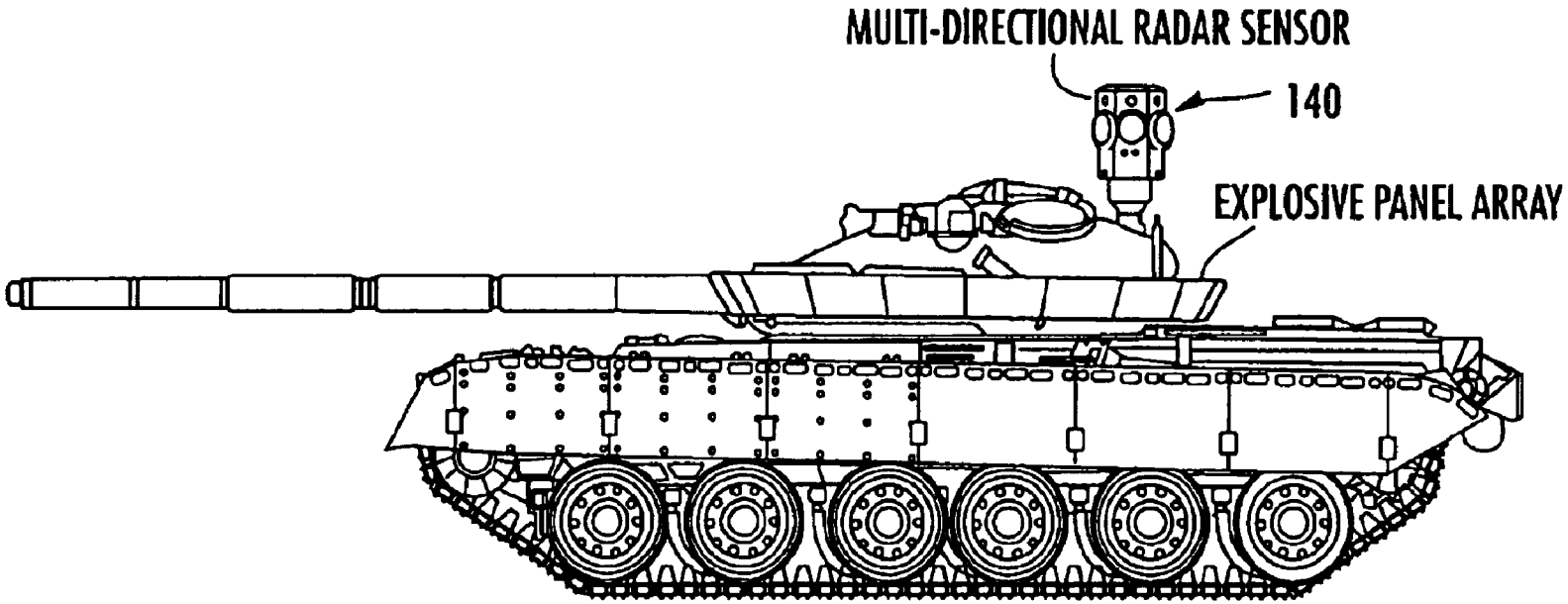
FIG. 5 is a schematic side view showing one example of the sensing device of this invention mounted on a tank.
Figure 6:
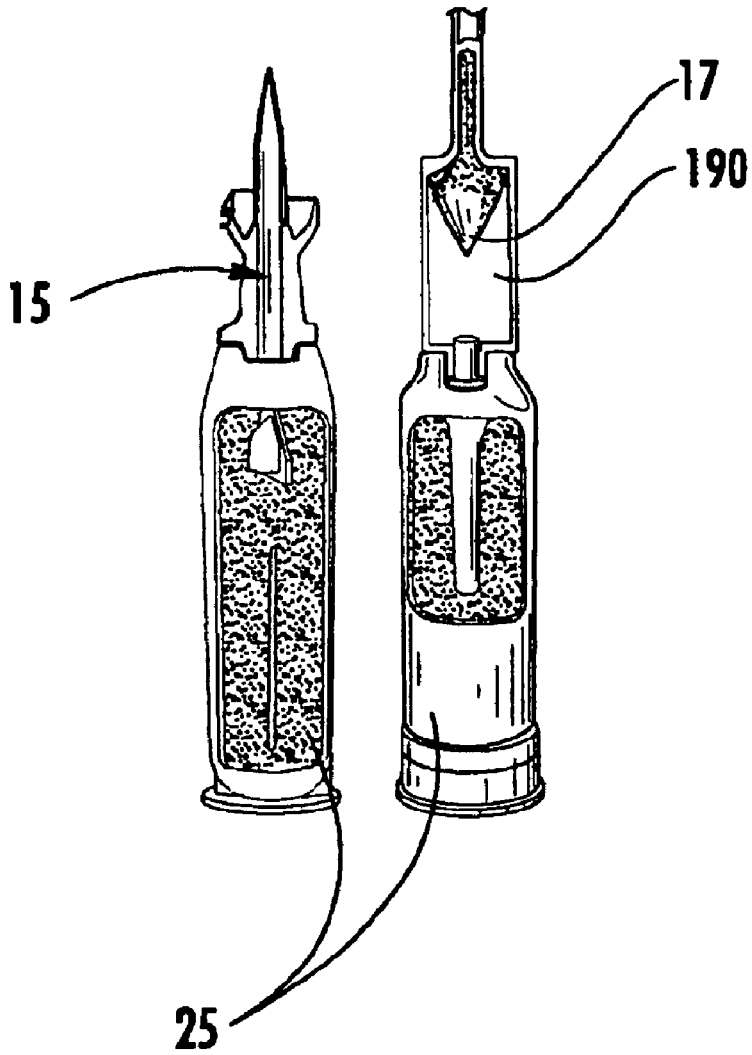
FIG. 6 is a schematic three-dimensional view showing examples of a KER threat and heat round threat.

Vehicle-borne system 100, FIG. 4 for countering incoming threat 120 of this invention includes sensing device 140 configured to sense incoming threat 120. Sensing device 140 may be a multidirectional radar sensor, as shown in FIG. 5. Incoming threat 120, FIG. 4 may be a kinetic energy round (KER), as indicated at 15, FIG. 6 which is used to penetrate the armor of a vehicle, such as a tank 21, FIG. 4, or armored personnel carrier 19, or similar armored vehicles. Incoming threat 120 may also be a shaped charge or heat round, as indicated at 17, FIG. 6, which is designed to penetrate the tank by creating many small fragments. The shaped type charge round indicated at 17 contains high explosive 190 and is often referred to as a heat round. This type of incoming threat warhead forms a hyper velocity jet which penetrates a tank wall at high velocity and destroys all tank components.

Figure 7B:
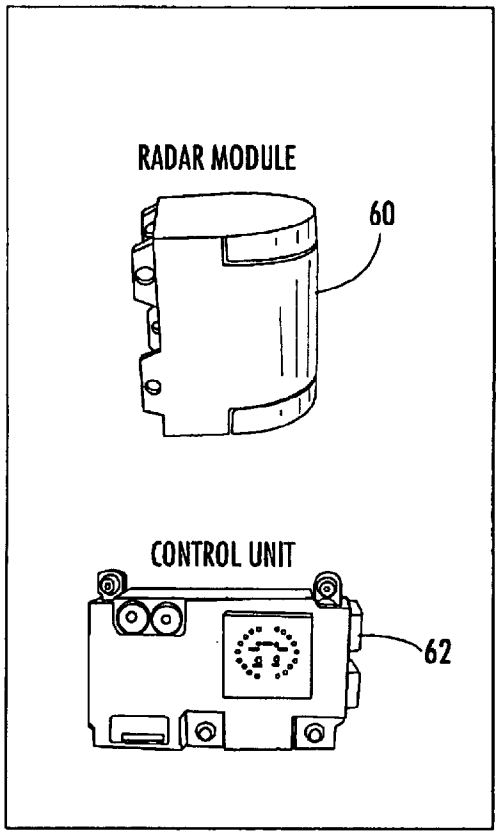
FIGS. 7A and 7B are schematic three-dimensional views showing the primary components associated with the active protection system of this invention.
Figure 7A:
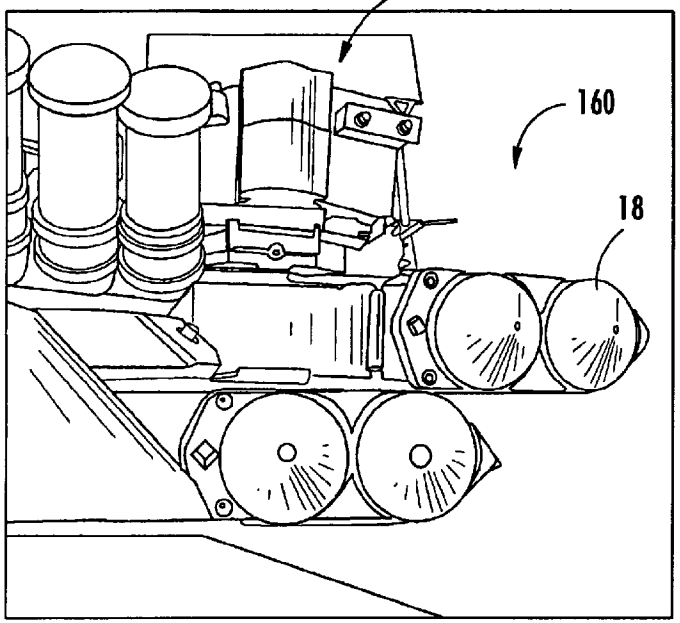

Vehicle-borne system 100, FIG. 4 also includes active protection system (APS) 160, shown in greater detail in FIG. 7A. Active Protection System 160 includes maneuverable interceptor 18 (shown in flight in FIG. 4) which incorporates a plurality of kinetic energy rods, such as kinetic energy rods 200, FIGS. 8A–8C and explosive charge 220 configured to aim kinetic energy rods 200 in a predetermined direction, e.g., at incoming threat 120, FIG. 4, as indicated by arrow 39.

Figures 8A, 8B, 8C:
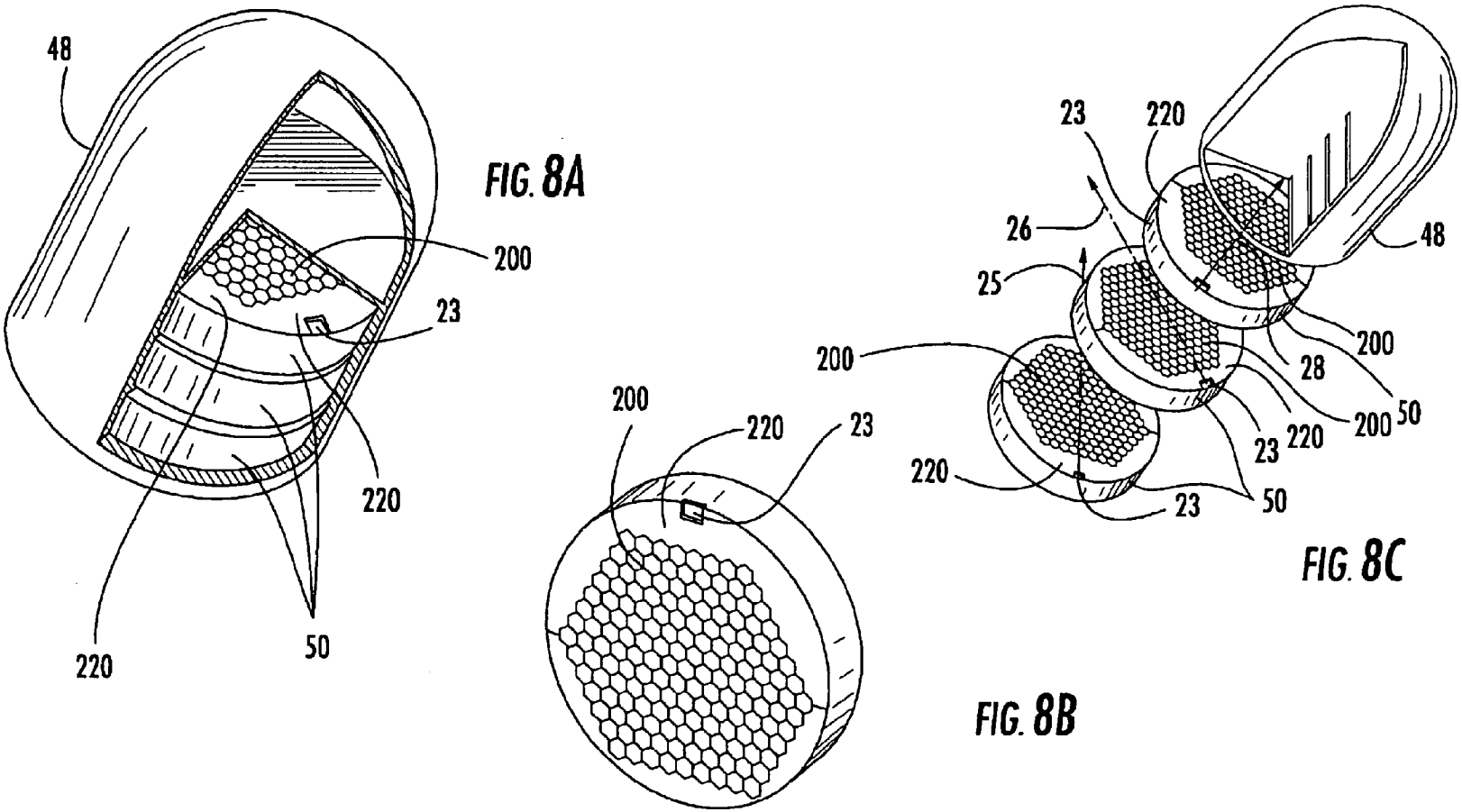
FIGS. 8A–8C are schematic three-dimensional views showing a plurality of bays in the warhead section of the maneuverable interceptor of this invention.

Interceptor 18 ideally includes a warhead section 48, shown in greater detail in FIGS. 8A and 8C which includes plurality of bays 50 for incorporating kinetic energy rods 200, detonator 23, and explosive charge 220. An enlarged view of a single bay section of plurality of bays 50 is shown in FIG. 8B. Plurality of bays 50, FIG. 8C are orientated such that kinetic energy rods 200 are deployed in different directions, as indicated by arrows 25, 26, and 28 to create disbursed cloud 34, FIG. 4. The shape of explosive charge section 220, FIG. 8C also aids in the formation of dispersed cloud 34 of kinetic rods, FIG. 4.

Figure 9:
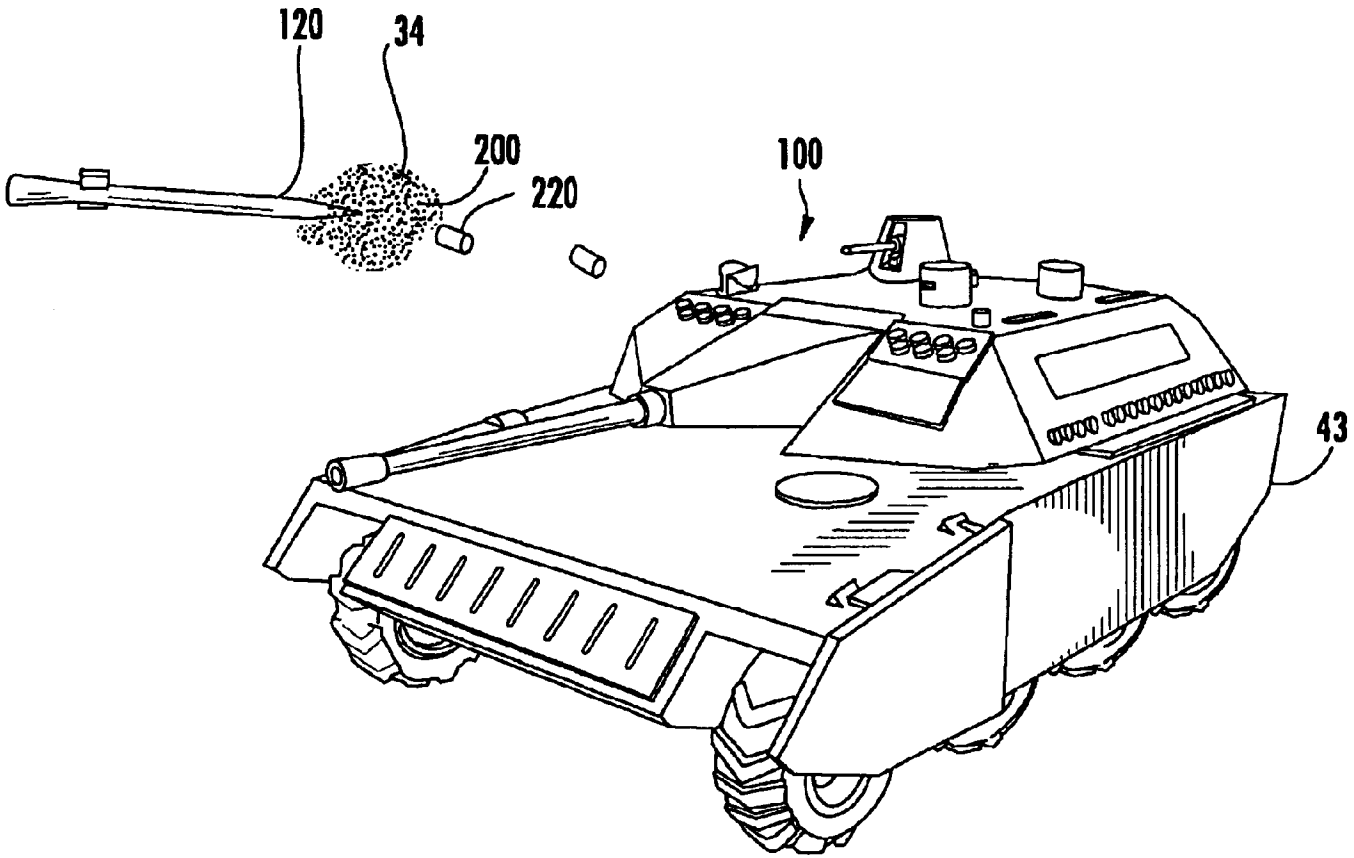
FIG. 9 is a schematic three-dimensional view showing the interceptor of this invention deploying all the kinetic energy rods in the direction of incoming threat to form a highly dense cloud of kinetic energy rods.

As shown in FIG. 9, interceptor or aimable explosive charge 220 of vehicle-borne system 100 mounted on tank 43 deploys all of kinetic energy rods 200 in the direction of incoming threat 120 to form highly dense cloud 34 of kinetic energy rods 200 which breaks and destroys incoming threat 120 on impact.

Figure 11:
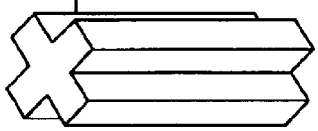
FIGS. 10–17 are three-dimensional schematic views showing different kinetic energy rod shapes useful in the interceptor of this invention.
Figure 13:
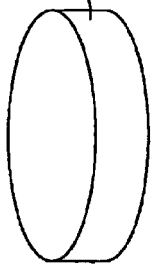
Figure 12:
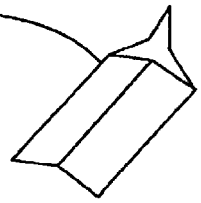
Figure 14:
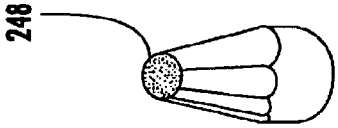
Figure 15:
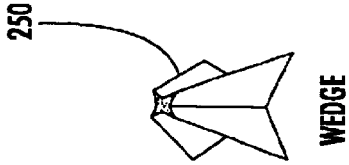
Figure 10:
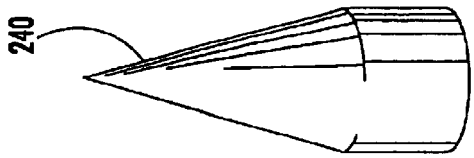
Figure 16:
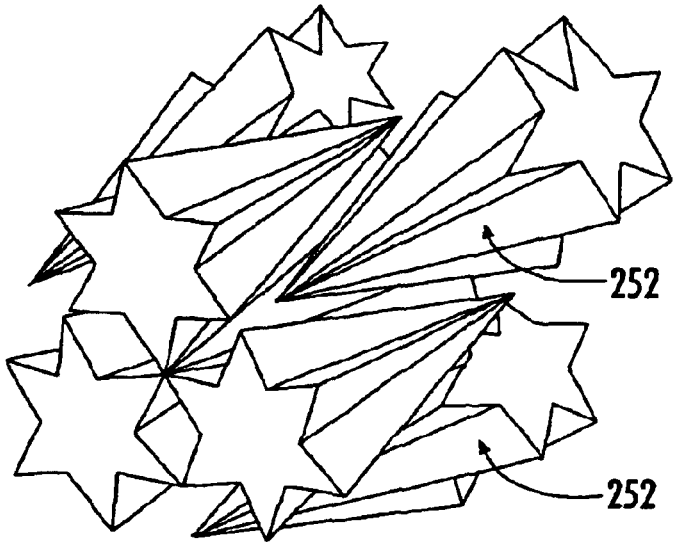
Figure 17:
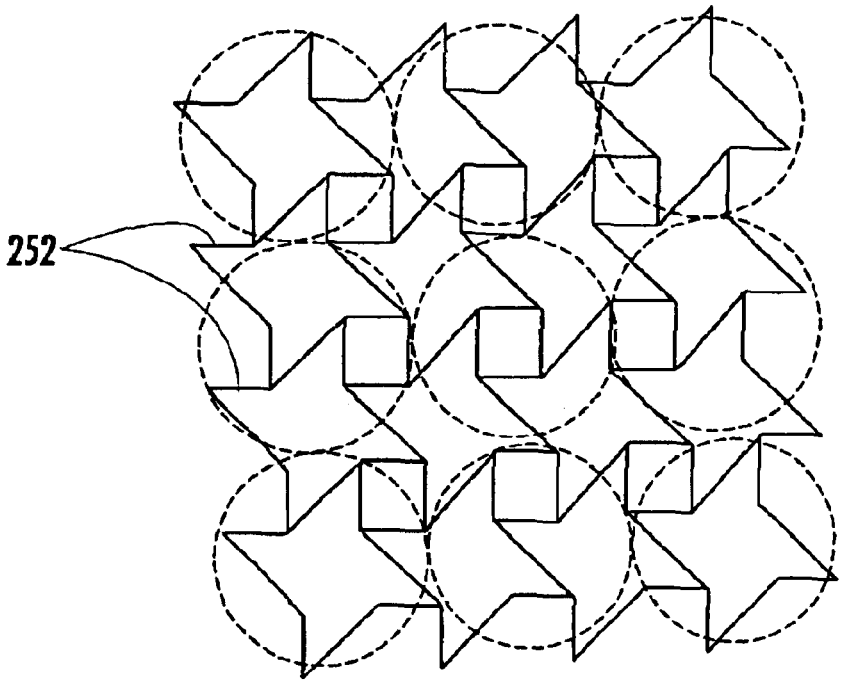

In one design, kinetic energy rods 200, FIGS. 4, and 8A–8C may be made of tantalum and may be hexagon shaped. Typically, the preferred kinetic energy rods (projectiles) do not have a cylindrical cross section and instead may have a star-shaped cross section, a cruciform cross section, or the like. Also, the kinetic energy rods may have a pointed nose or at least a non-flat nose such as a wedge-shaped nose. Kinetic energy rod 240, FIG. 10 has a pointed nose while projectile 242, FIG. 11 has a cruciform cross-section. Other kinetic energy rod shapes are shown at 244, FIG. 12 (a tristar-shape); projectile 246 (disk shaped), FIG. 13; projectile 248, FIG. 14; (truncated cone shaped nose), and wedge shaped projectile 250, FIG. 15. Kinetic energy rods or projectiles 252, FIG. 16 have a star-shaped cross section, pointed noses, and flat distal ends. The increased packaging efficiency of these specially shaped projectiles is shown in FIG. 17 where sixteen star-shaped projectiles can be packaged in the same space previously occupied by nine penetrators or projectiles with a cylindrical shape. Further details regarding the shapes and operation of the kinetic energy rods of this invention are found in the co-pending applications cited supra. Ideally, kinetic energy rods 20 are ductile in construction to prevent shattering of the rods upon deployment.

Active Protection System 160, FIG. 7A also includes detection subsystem 30 configured to support the maneuver of the interceptor 18 (also shown in FIG. 4) to intercept incoming threat 120. Detection subsystem 30, FIG. 7A is configured to determine if interceptor 18, FIG. 4 will miss incoming threat 120, as indicated by trajectory path 32, and if so, initiate explosive charge 220, FIGS. 8A–8C to aim kinetic energy rods 200 into disbursed cloud 34, FIG. 4 in the trajectory path of the incoming threat, e.g., trajectory path 40, which is between incoming threat 120 and vehicle 21 to destroy or disrupt trajectory path 40 of incoming threat 120.

Active protection system 160, FIG. 7A may include radar module 60, FIG. 7B for determining if interceptor 18 will miss incoming threat 120, FIG. 4. APS 160, FIG. 7A may also include control unit 62 for initiating the explosive charge (e.g., explosive charge 220, FIGS. 8A–8C) and aiming kinetic energy rods 220 to form disbursed cloud 34, FIG. 4, if interceptor 18 will miss incoming threat 120. System 100 also includes a maneuvering or thruster device (not shown) configured to maneuver interceptor 18 to intercept the incoming threat. Each interceptor 18, FIGS. 4 and 7A contains a small divert actuator control (DAC) system (not shown). The DAC system consists of propellant with small nozzles, based on the incoming threat type. The DAC fires to move interceptor 18 as close as possible to the enemy round or incoming threat 120. Ideally, the warhead is fired shortly before engagement.

The result is that vehicle-borne system 100, FIG. 4 of this invention effectively destroys or disrupts the flight path of incoming threat 120, even if interceptor 18 misses the intended incoming threat because disbursed cloud 34 with kinetic energy rods 220 disbursed therein can alter the flight path of incoming threat 120, as indicated by altered trajectory paths 46 and 47 such that the incoming threat will fall well short of the intended target vehicle, e.g., tank 21 or armored personnel carrier 19, or completely destroy incoming threat 120, as indicated by arrow 480.

Figure 18:
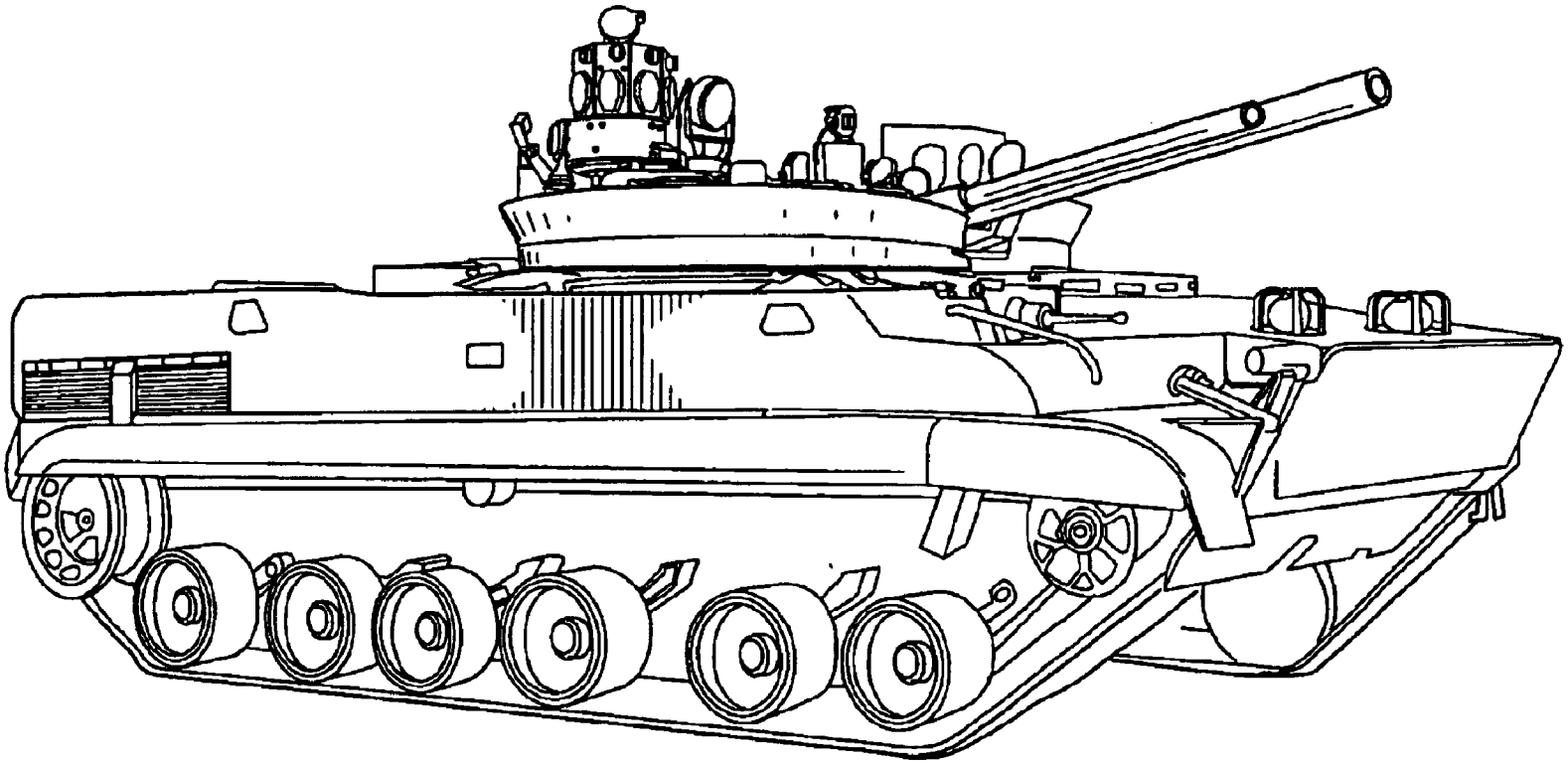
FIGS. 18–20 are schematic three-dimensional views showing the vehicle-borne system for countering an incoming threat of this invention mounted on various types of tanks.
Figure 19:
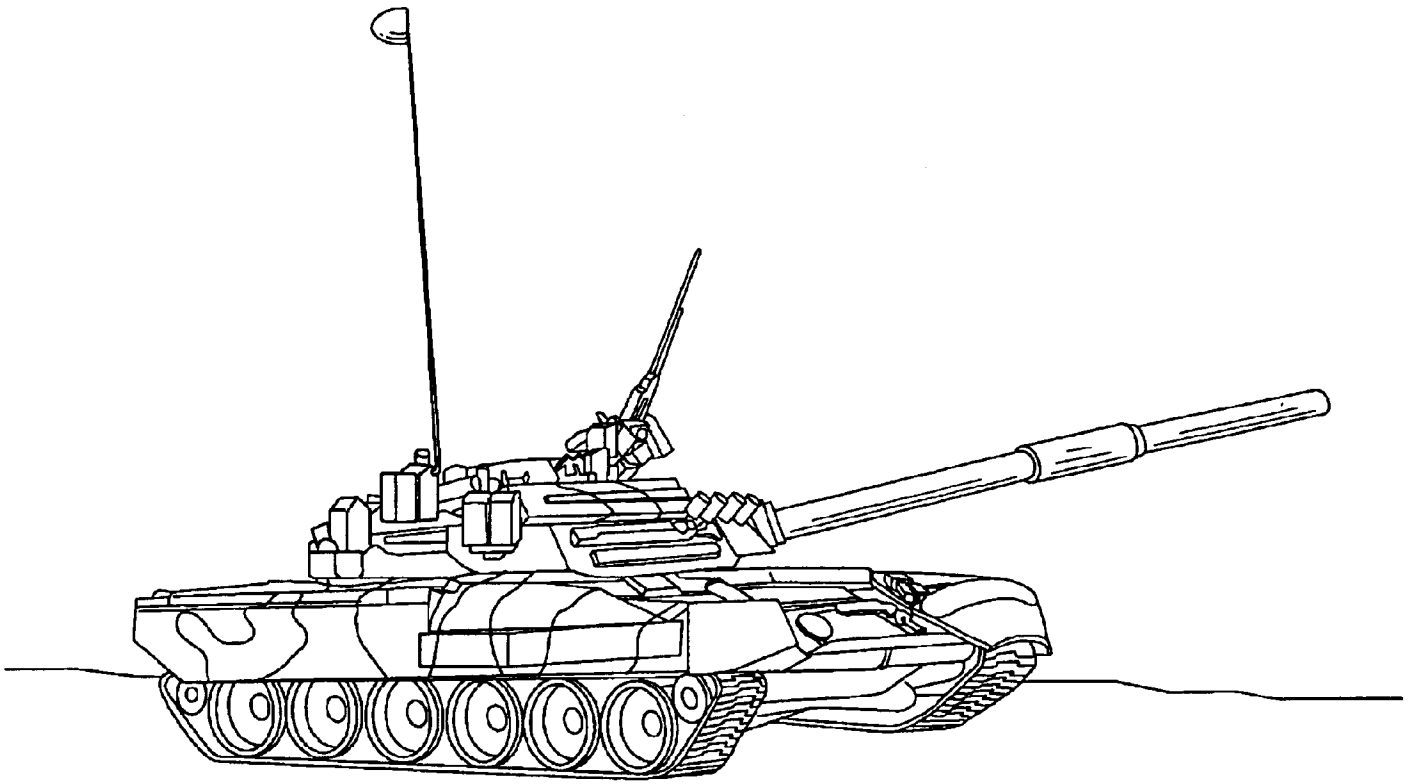
Figure 20:
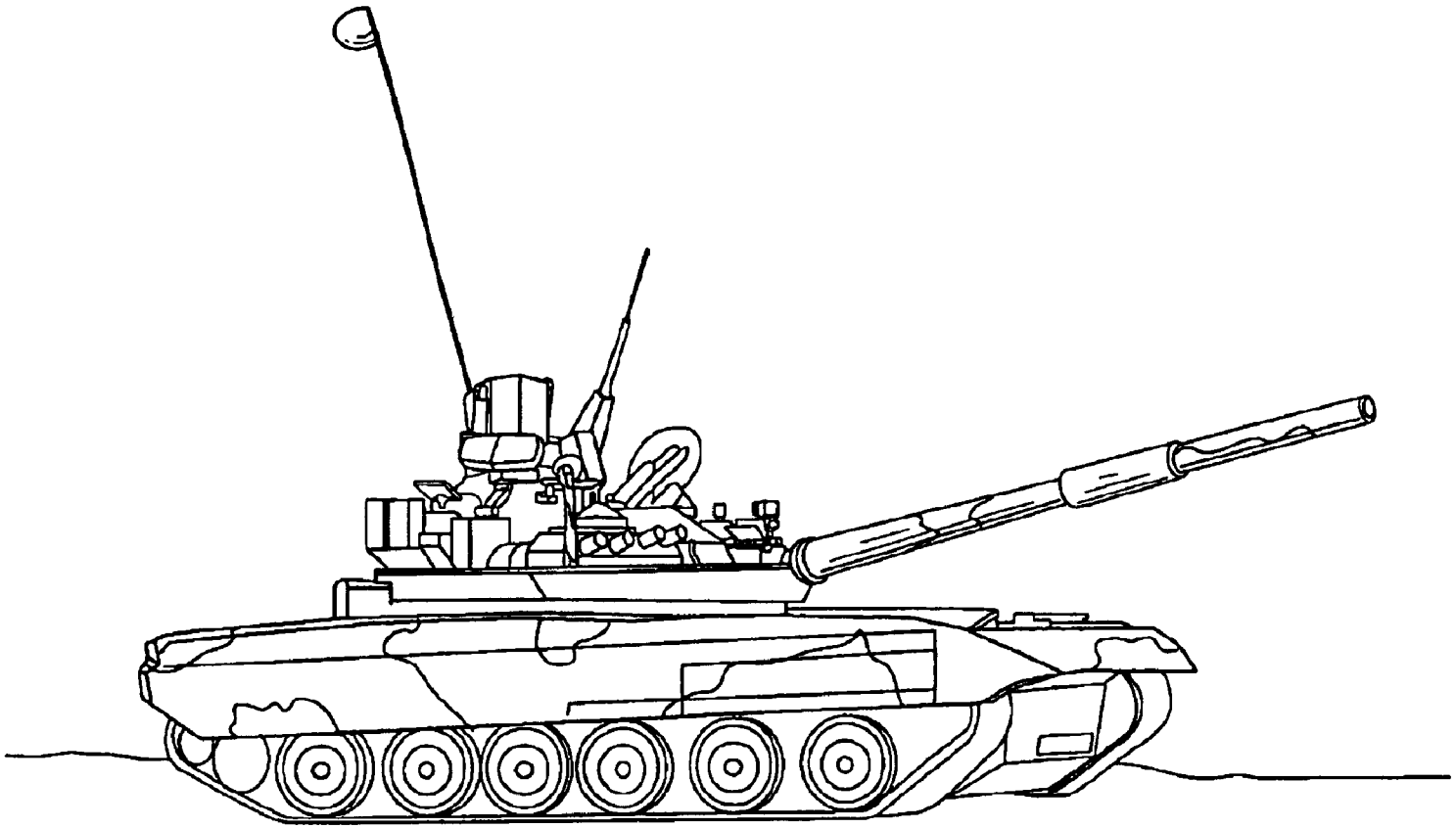
Figure 21:
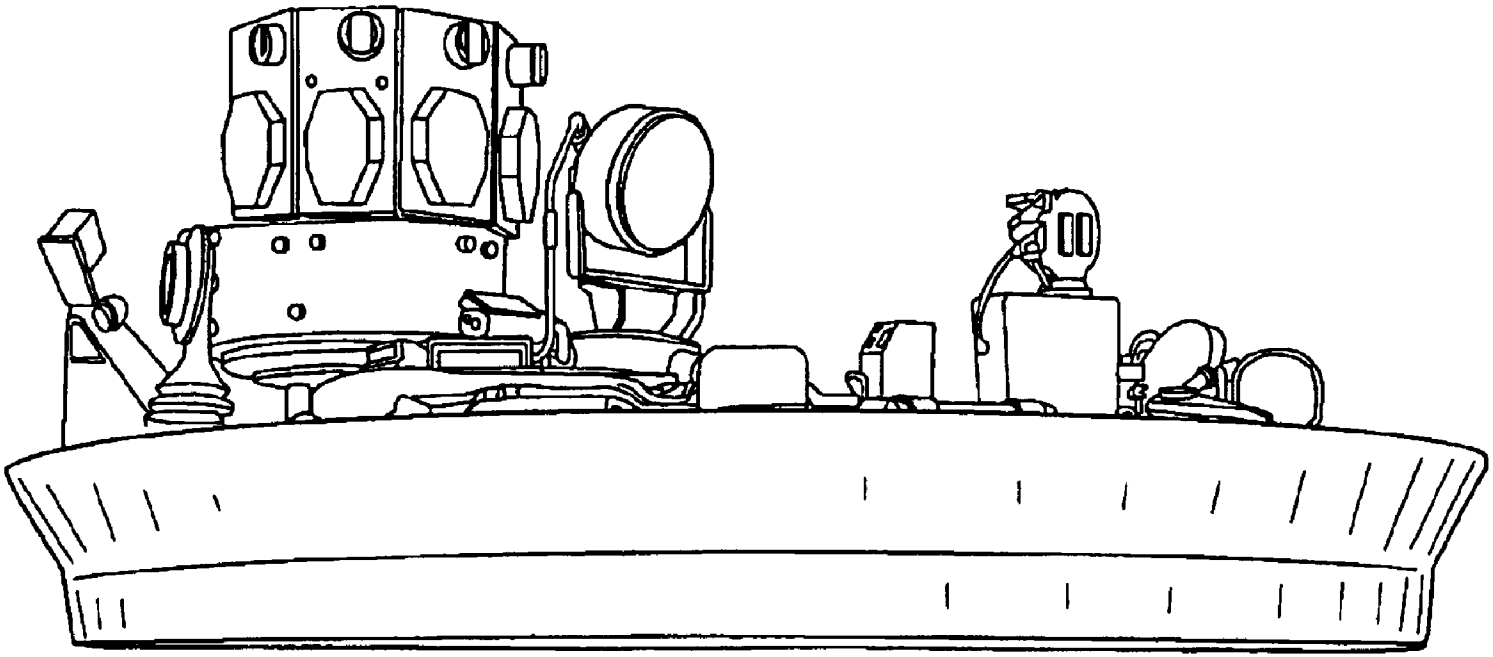
FIG. 21 is an enlarged three-dimensional schematic view showing the active protection system mounted on the tank shown in FIG. 18.

Typically, vehicle-borne system 100 of this invention is mounted on a tank, such as a BMP-3 ICV tank shown in FIG. 18, the T-80UM2 tank as shown in FIG. 19, or the T-80UM1 (Snow Leopard) tank as shown in FIG. 20. FIG. 21 shows an enlarged view of APS system 16, FIG. 7A, fitted on the BMP-3 ICV tank, FIG. 18. In other embodiments of this invention, vehicle-borne system 100 can be mounted on an armored personnel carrier, such as armored personnel carrier 19, FIG. 4.

Figure 22:
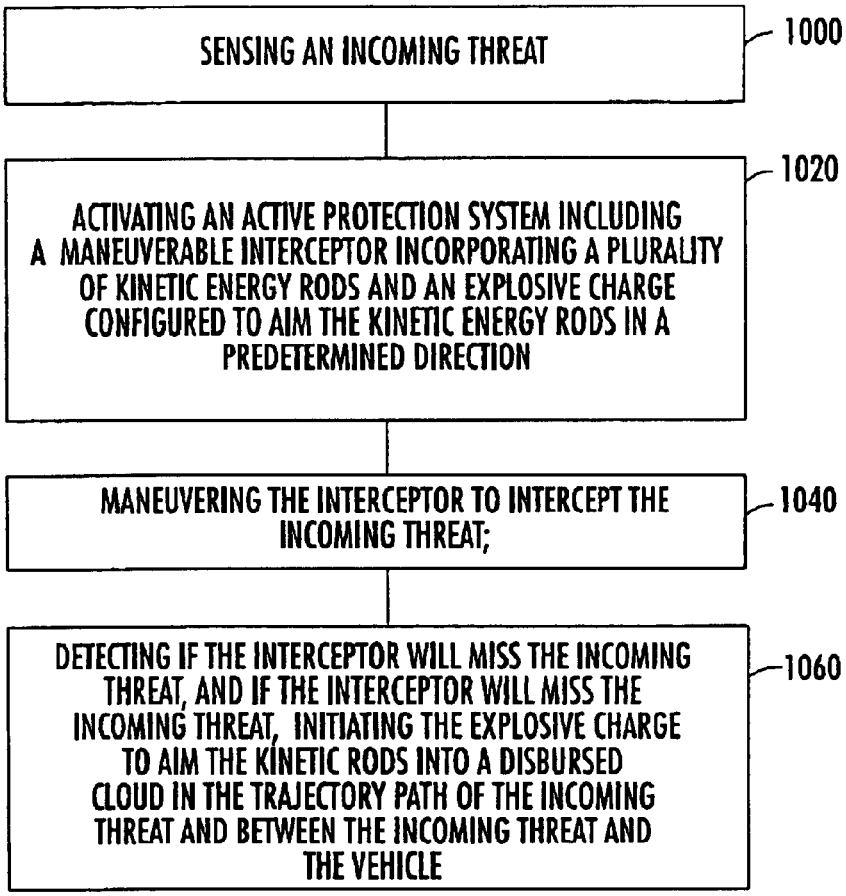
FIG. 22 is a schematic block diagram showing the primary steps associated with the vehicle-borne incoming threat countering method of this invention.

The vehicle-borne incoming threat countering method of the subject invention includes the steps of: sensing an incoming threat 120, FIG. 4, step 100, FIG. 22; activating active protection system 16, FIGS. 4 and 7A which includes maneuverable interceptor 18 incorporating a plurality of kinetic energy rods 200, FIGS. 4 and 8A–8C and explosive charge 220 configured to aim kinetic energy rods 200 in a predetermined direction to intercept incoming threat 120, FIG. 4, step 1020, FIG. 22; maneuvering interceptor 18 to intercept incoming threat 120. FIG. 4, step 1040, FIG. 22; detecting whether interceptor 18, FIG. 4 will miss incoming threat 120, and if interceptor 18 will miss incoming threat 120, then initiating explosive charge 220, FIGS. 8A and 8C to aim kinetic energy rods 200 into disbursed cloud 34, FIG. 4 in trajectory path 40 of incoming threat 120 and between incoming threat 120 and vehicle 21 or 19, step 1060, FIG. 22.

Although specific features of the invention are shown in some drawings and not in others, this for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A vehicle-borne system for countering an incoming threat, the system comprising;

a sensing device configured to sense an incoming threat; and an active protection system including a maneuverable interceptor incorporating a plurality of kinetic energy rods and an aimable explosive charge configured to deploy the kinetic energy rods in a predetermined direction; said active protection system further including a detection subsystem configured to maneuver the interceptor to intercept the incoming threat, said detection subsystem further configured to determine if the interceptor will miss the threat, and then initiate said explosive charge to aim the kinetic energy rods into a disbursed cloud in the trajectory path of the incoming threat and between the incoming threat and the vehicle.

2. The system of claim 1 in which the incoming threat is chosen from the group consisting of: a kinetic energy round munition, a shaped charged round, a heat round, a missile, an artillery, and a stabilized rod.

3. The system of claim 1 in which said vehicle is a tank.

4. The system of claim 1 in which said vehicle is an armored personnel carrier.

5. The system of claim 1 in which said interceptor includes a warhead section with a plurality of bays for holding said plurality of kinetic energy rods.

6. The system of claim 5 in which said bays are orientated such that said kinetic energy rods are deployed in different predetermined directions for creating said disbursed cloud.

7. The system of claim 1 in which said detection subsystem includes a radar module for determining if the interceptor will hit or miss the incoming threat.

8. The system of claim 1 in which said detection subsystem includes a control unit for initiating said explosive charge.

9. The system of claim 1 in which said kinetic energy rods are made of high density tantalum.

10. The system of claim 1 in which said kinetic energy rods have a ductile composition for preventing shattering thereof upon impact with the incoming threat.

11. The system of claim 1 in which said rods are hexagon shaped.

12. The warhead of claim 1 in which the kinetic energy rods have a cylindrical cross section.

13. The warhead of claim 1 in which the kinetic energy rods have a non-cylindrical cross section.

14. The warhead of claim 1 in which the kinetic energy rods have a star-shaped cross section.

15. The warhead of claim 1 in which the kinetic energy rods have a cruciform cross section.

16. The warhead of claim 1 in which the kinetic energy rods are disk shaped with flat ends.

17. The warhead of claim 1 in which the kinetic energy rods have a non-flat nose.

18. The warhead of claim 1 in which the kinetic energy rods have a pointed nose.

19. The warhead of claim 1 in which the kinetic energy rods have a wedge-shaped nose.

20. The system of claim 1 in which said explosive charge is shaped such that detonation of said charge deploys said plurality of kinetic energy rods in a predetermined direction to form said disbursed cloud.

21. The system of claim 1 in which said vehicle is a tank chosen from the group consisting of a BMP-3 tank, a T-80MBT tank, a BMP-3 ICV tank, an ARENA APS tank, and a T-80UM2 tank.

22. A vehicle-borne incoming threat countering method, the method comprising:

sensing an incoming threat;

activating an active protection system including a maneuverable interceptor incorporating a plurality of kinetic energy rods and an aimable explosive charge configured to deploy the kinetic energy rods in a predetermined direction;

maneuvering the interceptor to intercept the incoming threat;

detecting whether the interceptor will miss the incoming threat; and if the interceptor will miss the incoming threat, then initiating the explosive charge to aim the kinetic energy rods into a disbursed cloud in the trajectory path of the incoming threat and between the incoming threat and the vehicle.

23. The method of claim 22 in which the incoming threat is chosen from the group consisting of a kinetic energy round munition, a shaped charge round, a heat round, a missile, an artillery, and a stabilized rod.

24. The method of claim 22 in which said vehicle is a tank.

25. The method of claim 22 in which said vehicle is an armored personnel carrier.

26. The method of claim 22 in which said interceptor includes a warhead section with a plurality of bays for holding said plurality of kinetic energy rods.

27. The method of claim 26 in which said bays are orientated such that said kinetic energy rods are deployed in different predetermined directions for creating said disbursed cloud.

28. The method of claim 22 in which said detecting includes a radar module for determining if the interceptor will hit or miss the incoming threat.

29. The method of claim 22 in which said detecting includes a fuze control unit for initiating said explosive charge.

30. The method of claim 22 in which said kinetic energy rods are made of tantalum.

31. The method of claim 22 in which said rods are hexagon shaped.

32. The method of claim 22 in which the kinetic energy rods have a cylindrical cross section.

33. The method of claim 22 in which the kinetic energy rods have a non-cylindrical cross section.

34. The method of claim 22 in which the kinetic energy rods have a star-shaped cross section.

35. The method of claim 22 in which the kinetic energy rods have a cruciform cross section.

36. The method of claim 22 in which the kinetic energy rods have flat ends.

37. The method of claim 22 in which the kinetic energy rods are disk shaped.

38. The method of claim 22 in which the kinetic energy rods have a non-flat nose.

39. The method of claim 22 in which the kinetic energy rods have a pointed nose.

40. The method of claim 22 in which the kinetic energy rods have a wedge-shaped nose.

41. The method of claim 22 in which said kinetic energy rods have a ductile composition for preventing shattering thereof.

42. The method of claim 22 in which said explosive charge is shaped such that detonation of said charge deploys said plurality of kinetic energy rods in a predetermined direction to form said disbursed cloud.

43. The method of claim 22 in which said vehicle is a tank chosen from the group consisting of a BMP-3 tank, a T-80MBT tank, a BMP-3 ICV tank, an ARENA APS tank, and a T-80UM2 tank.

* * * * *

UNITED STATES PATENT AND TRADEMARK OFFICE

CERTIFICATE OF CORRECTION

PATENT NO. : 6,920,827 B2
DATED : July 26, 2005
INVENTOR(S) : Richard M. Lloyd

It is certified that error appears in the above-identified patent and that said Letters Patent is hereby corrected as shown below:

Title page,
Item [75], "Inventor: Richard M. Llyod, Melrose, MA (US)" should read -- Inventor: Richard M. Lloyd, Melrose, MA (US) --.

Signed and Sealed this

Twenty-seventh Day of September, 2005

JON W. DUDAS
*Director of the United States Patent and Trademark Office*